US008167278B2

(12) United States Patent
Cincotta

(10) Patent No.: US 8,167,278 B2
(45) Date of Patent: May 1, 2012

(54) ANGLED DIFFUSER AND STEAM INJECTION HEATER ASSEMBLY

(75) Inventor: Bruce A. Cincotta, Wauwatosa, WI (US)

(73) Assignee: Prosonix, LLC, Wauwatosa, WI (US)

( * ) Notice: Subject to any disclaimer, the term of this patent is extended or adjusted under 35 U.S.C. 154(b) by 623 days.

(21) Appl. No.: 12/358,479

(22) Filed: Jan. 23, 2009

(65) Prior Publication Data

US 2009/0200688 A1 Aug. 13, 2009

Related U.S. Application Data

(60) Provisional application No. 61/023,132, filed on Jan. 24, 2008.

(51) Int. Cl.
*B01F 3/04* (2006.01)

(52) U.S. Cl. ..... 261/62; 261/124; 261/DIG. 10; 261/DIG. 76

(58) Field of Classification Search ..... 261/41.1, 261/41.4, 62, 124, DIG. 10, DIG. 13, DIG. 76
See application file for complete search history.

(56) References Cited

U.S. PATENT DOCUMENTS 240,831 A * 5/1881 Macfarlane ..... 261/124
712,368 A * 10/1902 Ebner ..... 261/19
2,271,764 A * 2/1942 Heil ..... 239/596
3,219,483 A * 11/1965 Goos et al. ..... 127/28
4,086,308 A * 4/1978 Jurgens et al. ..... 261/124
4,130,611 A * 12/1978 Brand ..... 261/66
4,139,585 A * 2/1979 Kirschner et al. ..... 261/64.1
4,269,791 A * 5/1981 Hills ..... 261/36.1
4,820,457 A * 4/1989 Jager ..... 261/120
5,692,684 A * 12/1997 Zurmuhlen ..... 239/563
6,361,025 B1 * 3/2002 Cincotta et al. ..... 261/77
6,955,340 B2 * 10/2005 Palm ..... 261/62
2002/0089075 A1 * 7/2002 Light et al. ..... 261/118

* cited by examiner

*Primary Examiner* — Richard L Chiesa
(74) *Attorney, Agent, or Firm* — Joseph S. Heino; Patrick M. Bergin

(57) ABSTRACT

An improved configuration for an in-line direct contact diffuser-type steam injection heater provides for a diffuser whereby steam flow is controlled using an angled sonic diffuser and plug arrangement. The steam flow is controlled by means of a steam plug which selectively exposes holes through which the steam passes. In the preferred embodiment, the configuration provides for a diffuser that had been angled approximately 30° from vertical to facilitate better mixing of the steam with the fluid. The precise angle may be altered depending on the fluid characteristics. A more durable end seal is also used. The end seal is a piston ring which prevents problems associated with the use of elastomeric rings of existing art. A more uniform diameter plug with linear travel is also an improvement over the prior art.

8 Claims, 7 Drawing Sheets

ANGLED DIFFUSER AND STEAM INJECTION HEATER ASSEMBLY

This application claims the benefit and priority of U.S. Provisional Patent Application No. 61/023,132 filed Jan. 24, 2008.

FIELD OF THE INVENTION

The present invention relates generally to direct contact steam injection heaters that are used for heating certain types of slurries. More specifically, it relates to an angled diffuser that is used within a diffuser-type steam injection heater assembly.

BACKGROUND OF THE INVENTION

In direct contact steam injection heaters, steam is directly mixed into a flowing fluid (e.g. liquid or slurry) that is in the process of being heated. Direct contact steam injection heaters are well known in the art and are very effective at transferring heat energy to the flowing fluid. They provide rapid heat transfer with virtually no heat loss to the atmosphere, and also transfer both the latent and the available sensible heat of the steam to the liquid slurry.

Diffuser-type steam injection heaters are also known in the art. In the experience of this inventor, previous designs of diffuser-type steam injection heaters have utilized generally two-dimensional mixing strategies that tend to limit the steam flow to a small vertical spacing from the diffuser. As a result, there can be poor steam distribution throughout the fluid to be heated and subsequently "hot pockets" inside the pipe. In a highly viscous fluid, these hot pockets can lead to instability and "steam hammer." This can also lead to damaging of the equipment, including the associated piping.

Another shortcoming of previous designs of diffuser-type steam injection heaters is that the plug that is carried within the diffuser typically utilizes a rotary, elastomeric, or otherwise pliant, seal design. In the experience of this inventor, such seals can quickly wear out as they ride over the holes that are contained within the diffuser. This occurs because the seals can "extrude" into and be damaged by the diffuser holes as the seals are repeatedly moved across the holes. Additionally, prior designs of diffuser-type steam injection heaters have used window-type openings in the plug and a rotary motion to control steam flow from the diffuser. In the experience of this inventor, such windows can lead to deformation in the plug when under pressure. Such deformation causes non-uniform gaps between the plug and the diffuser together with uneven and premature wear. It also causes premature plug failure.

SUMMARY OF THE INVENTION

In view of the foregoing, what is needed is an improved configuration for an in-line direct contact diffuser-type steam injection heater. The present invention provides such a configuration. Generally, the configuration of the present invention provides for an angled diffuser whereby steam flow is controlled using a generally sonic diffuser and plug arrangement. The steam flow is controlled by means of a steam plug which selectively exposes holes through which the steam passes.

Specifically, the configuration of the present invention provides for a diffuser that had been angled approximately 30° from vertical to facilitate better mixing of the steam with the fluid. The precise angle may be altered depending on the fluid characteristics. Also, a more durable end seal is used. The end seal in the present invention is a sealing ring which prevents problems associated with the use of elastomeric rings of existing art. A more uniform diameter plug with linear travel is also an improvement over the prior art.

Other specific improvements embodied in the configuration of the present invention include the feature of an upper chamber seal that is contained outside of the diffuser and that seals two surfaces. That is, the upper chamber seal serves as a face seal to prevent flow into the diffuser through the side wall and it also prevents flow between the plug and the diffuser. Additionally, a filler material may be provided to prevent infiltration of fluid or solids into the steam chamber. The filler material is optionally added to the space between the plug and diffuser to prevent slurry solids from migrating into the space during down time. Finally, variable diffuser hole diameters are used to maintain adequate max flux of steam to penetrate viscous fluids, it being known that different fluid viscosities require differing steam jet characteristics in order to penetrate and condense in the flowing liquid.

The foregoing and other features of the angled diffuser and assembly of the present invention will be apparent from the detailed description that follows.

DETAILED DESCRIPTION OF THE INVENTION

Figure 1A:
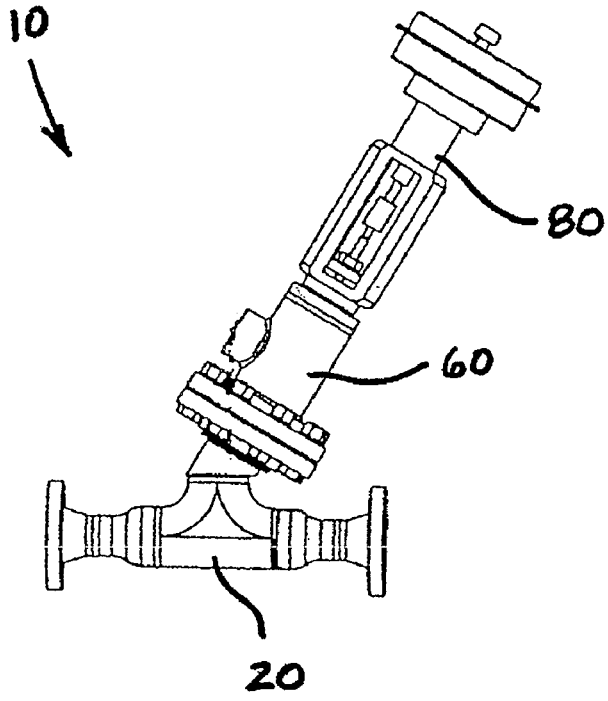
FIG. 1A is a right side elevational view of an angled diffuser and assembly that is constructed in accordance with the present invention.
Figure 1B:
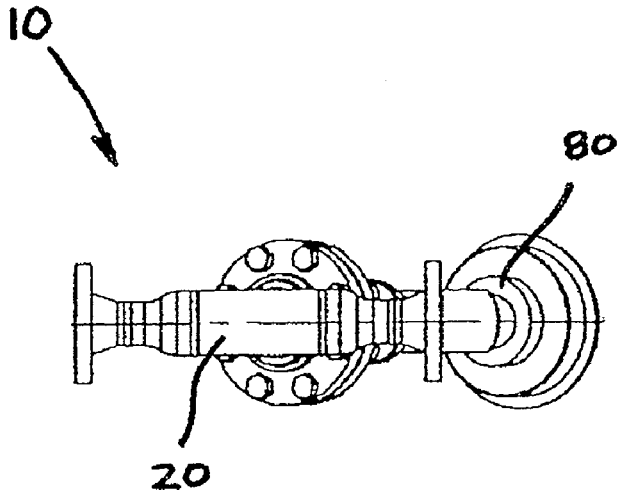
FIG. 1B is a bottom plan view of the angled diffuser and assembly shown in FIG. 1A.
Figure 1C:
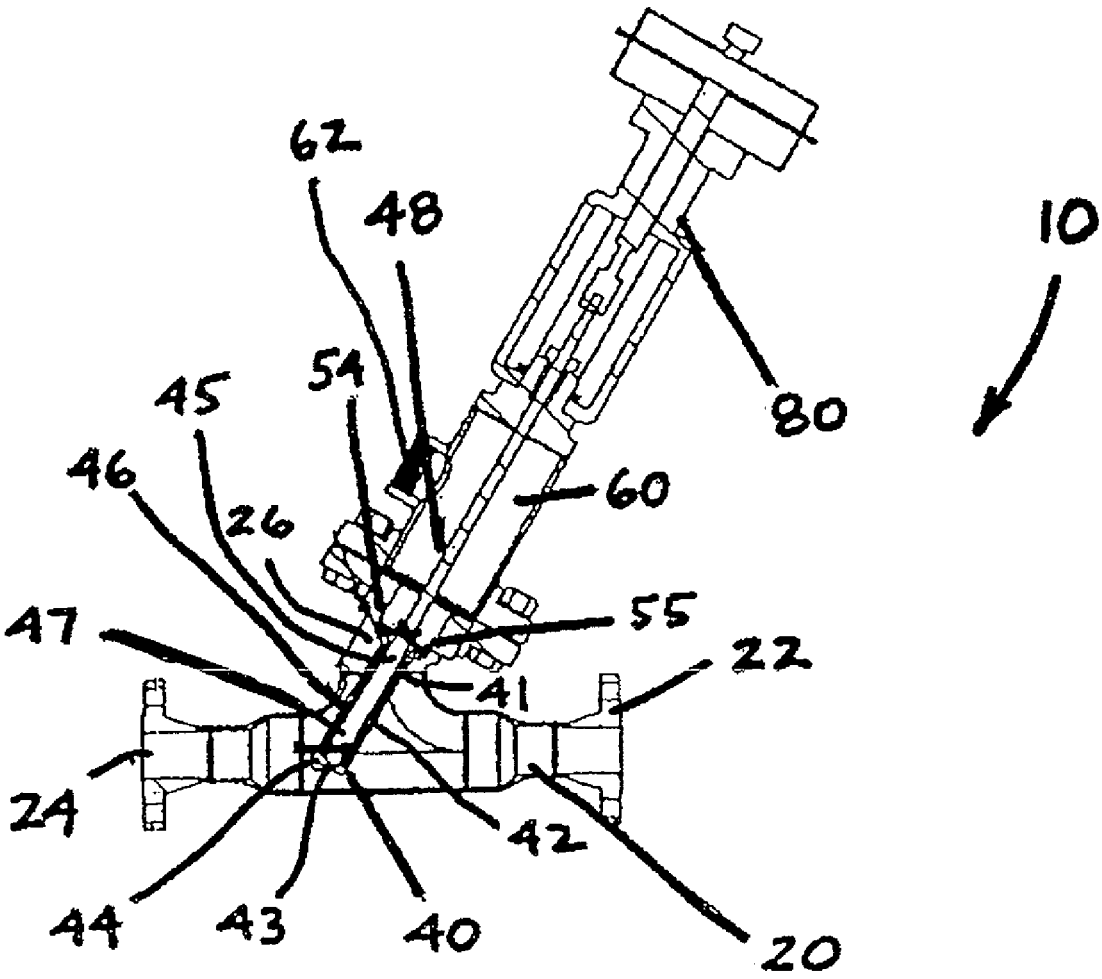
FIG. 1C is a view similar to that shown in FIG. 1A but showing the angled diffuser and assembly as cross-sectioned.

Referring now to the drawings in detail, wherein like numbered elements correspond to like elements throughout, FIGS. 1A through 1C show the angled diffuser and assembly, generally identified 10, constructed in accordance with the present invention. As shown in FIG. 1A, it will be seen that the assembly 10 comprises several component parts. The primary parts are the liquid chamber 20, the diffuser 40, the steam chamber 60 and the actuator 80.

Figure 2:
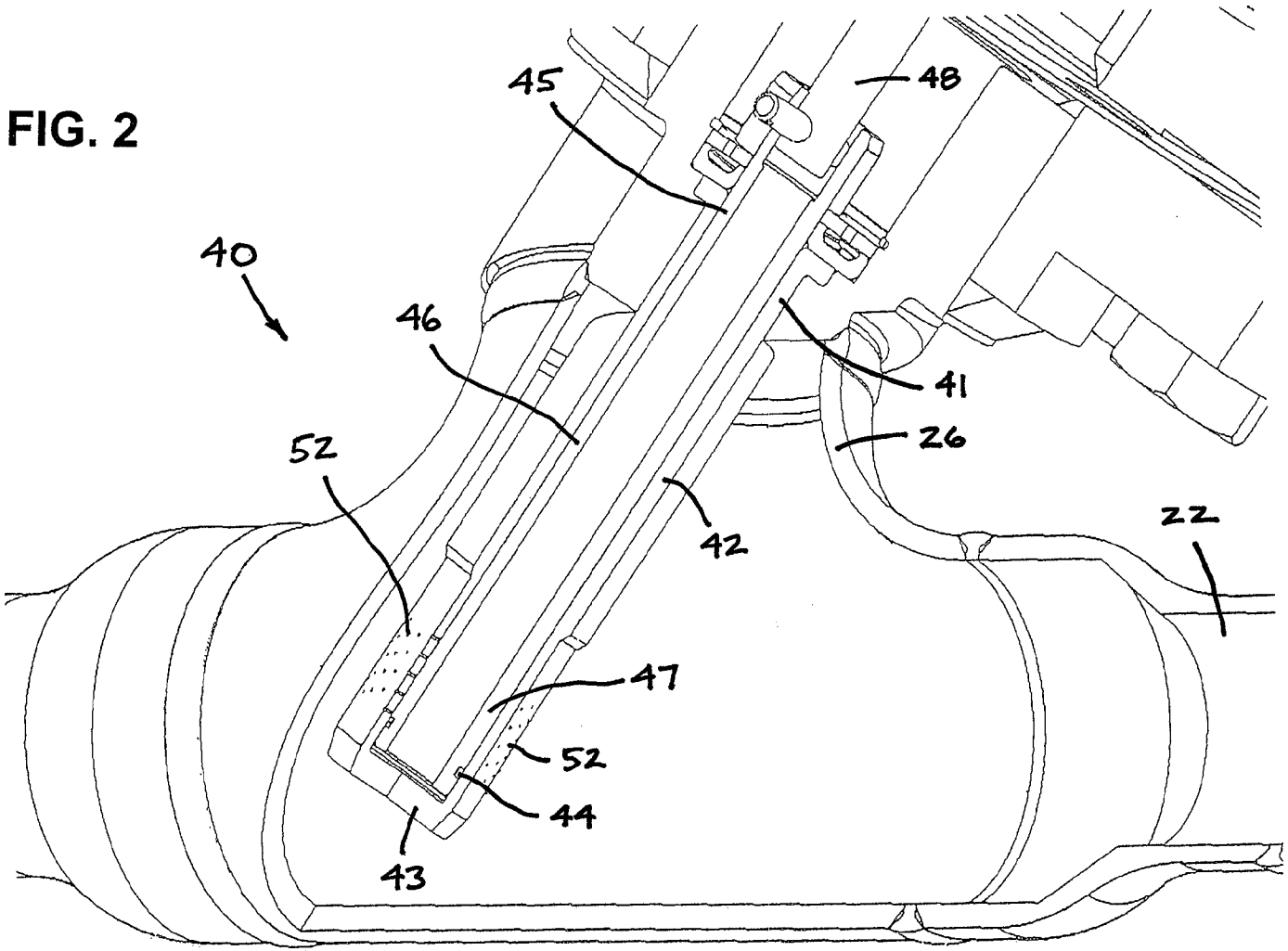
FIG. 2 is a further enlarged and partially sectioned perspective view showing the angled diffuser in a "closed" position.
Figure 3:
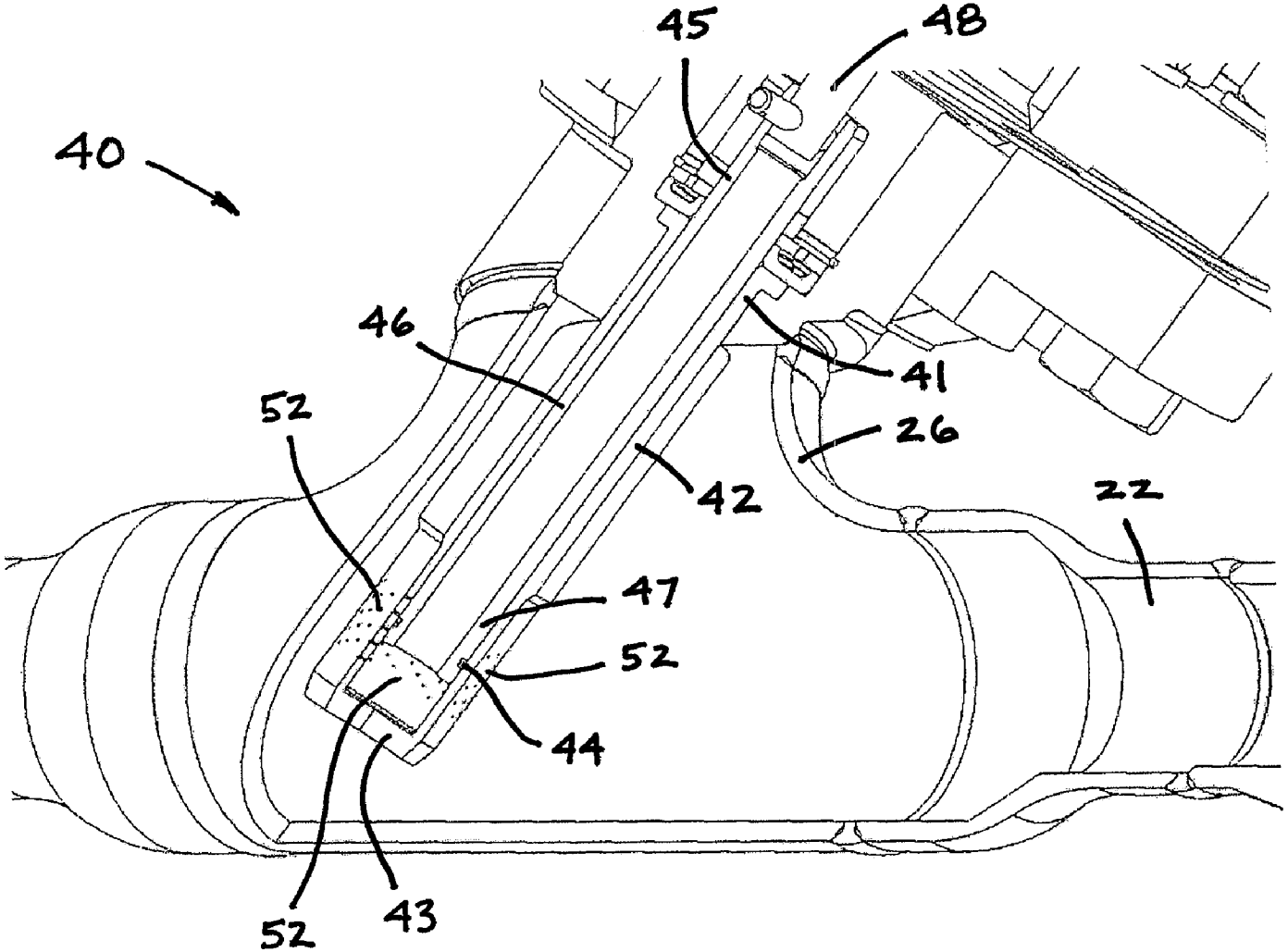
FIG. 3 is a view similar to that shown in FIG. 2 but illustrating the angled diffuser in a partially "open" position.
Figure 5:
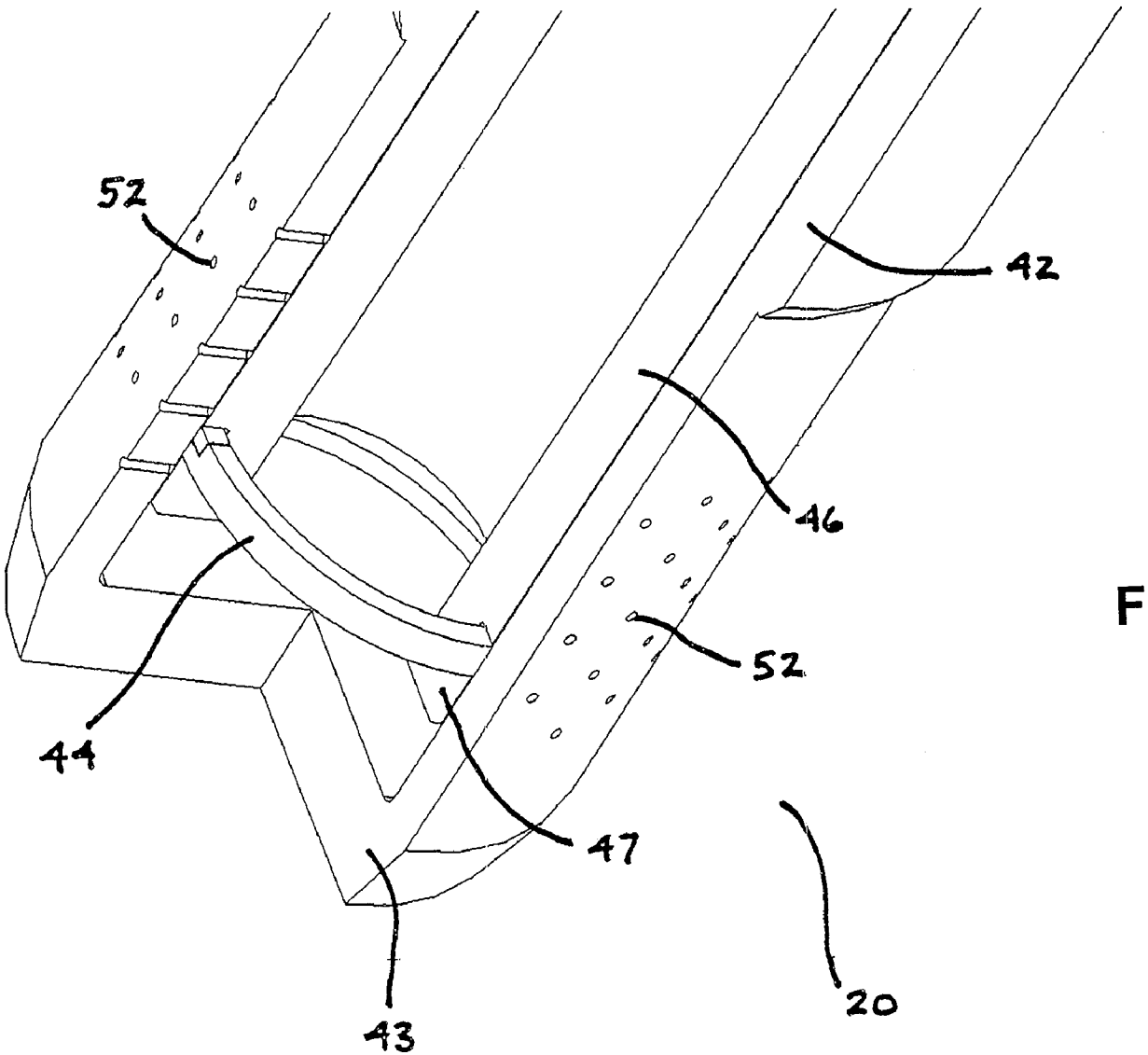
FIG. 5 is a greatly enlarged and partially sectioned side elevational view showing the lower portion of the angled diffuser.

The liquid chamber 20 includes a fluid inlet 22 and a fluid and steam outlet 24. The liquid chamber 20 also includes an aperture 26 to which is mounted the diffuser 40. The diffuser 40 includes a diffuser body 42 having a proximal end 41 and a distal end 43. Movable within the diffuser body 42 is a modulating plug 46. The modulating plug 46 has a proximal end 45 and a distal end 47. It is to be understood that the modulating plug 46 of the preferred embodiment is configured to be of a uniform diameter and to travel linearly within the diffuser body 42. A sealing ring 44 is disposed at the distal end 47 of the modulating plug 46. See also FIGS. 2, 3 and 5. The proximal end 45 of the modulating plug 46 is attached to a modulating stem 48 which is, in turn, attached to the actuator 80, the actuator 80 being used to move the modulating stem 48 axially within the steam chamber 60. By this movement, the amount of full pressure steam (i.e. the full amount of steam pressure available) added to the flowing liquid or slurry is modulated.

Steam modulation occurs at the distal end 43 of the diffuser body 42 within which a plurality of diffusion holes 52 are defined. See FIG. 5. See also FIG. 2 which shows the diffuser 40 in its "closed" position and FIG. 3 which shows the diffuser 40 in a partially "open" position. It is to be understood that the holes 52 are, in the preferred embodiment of the present invention, configured of potentially different diameters to maintain adequate mass flux of steam to penetrate viscous fluid passing through the liquid chamber 20.

Figure 4:
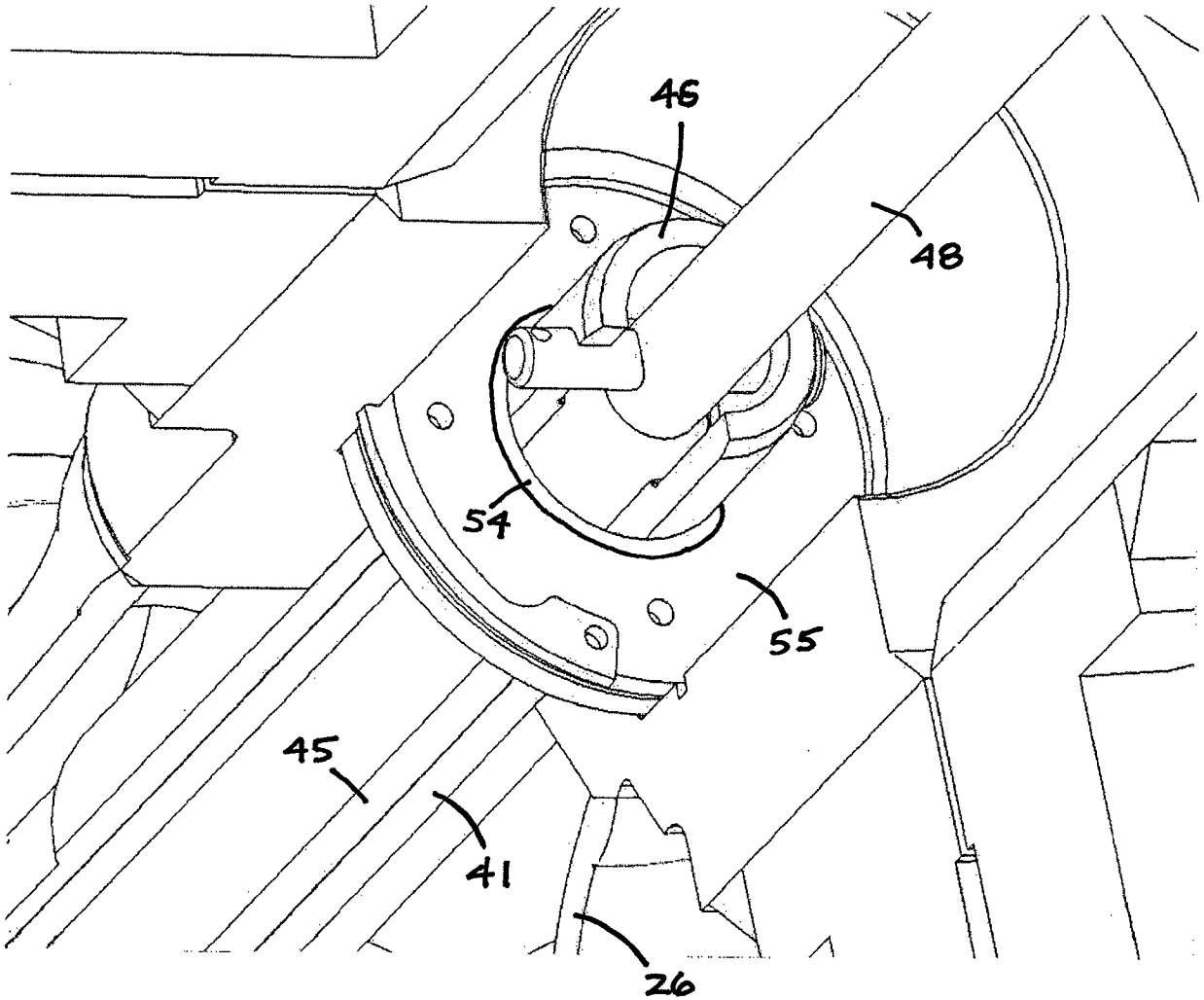
FIG. 4 is a greatly enlarged and partially sectioned perspective view showing the upper portion of the angled diffuser.

The diffuser 40 also includes an external plug seal 54 that is disposed at the proximal end 41 of the diffuser body 42, the external plug seal 54 being retained by a seal support plate 55. As previously alluded to, the seal 54 is contained outside of the diffuser 40 and seals two surfaces. First, it serves as a face seal to prevent flow into the diffuser 40 through the side wall of the liquid chamber 20. Second, it prevents flow between the plug 46 and the diffuser body 42. See FIG. 4.

In application, and as fluid follows a flow path from the fluid inlet 22 of the liquid chamber and out of the fluid and steam outlet 24 thereof, steam is introduced by means of a steam inlet 62 which passes through the steam chamber 60 and into the central aperture 56 of the modulating plug 46. See FIG. 4. The steam path continues through the aperture 56 of the modulating plug 46 to the distal end 47 thereof. At this point, steam exits the diffusion holes 52 that are defined in the distal end 43 of the diffuser body 42. See FIG. 5. At this point, it should be appreciated that the axial linear position of the diffuser 40 is presented at an angle relative to the axial linear position of the liquid chamber 20 and the linear axial flow of fluid through the liquid chamber 20. In the preferred embodiment, this angle is an acute angle that presents at about 30° relative to the vertical, which is about 60° relative to the axis or linear axial position of the liquid chamber 20. Optimally, this angle may range between 0° and 40° relative to the vertical, or 90° and 50° relative to the axis or linear axial position of the liquid chamber 20. The functionality of this "angled" presentation is to effect better mixing of the steam with the fluid.

Additional advantages and modifications will readily occur to those skilled in the art. Therefore, the invention in its broader aspects is not limited to the specific details disclosed and described herein.

The details of the invention having been disclosed in accordance with the foregoing, I claim:

1. An angled diffuser for use within a direct contact steam injection heater assembly, the assembly comprising a liquid chamber, the liquid chamber comprising a fluid inlet, a combined fluid and steam outlet, and a steam inlet aperture disposed between the fluid inlet and the combined fluid and steam outlet, the liquid chamber defining an axial linear liquid flow path through the liquid chamber, the diffuser comprising:

a diffuser body, the diffuser body comprising a proximal end and a distal end, the diffuser body further comprising an axial linear position;

a plurality of diffusion holes defined within the distal end of the diffuser body;

a modulating plug that is movable within the diffuser body, the modulating plug comprising a proximal end and a distal end;

a sealing ring disposed at the distal end of the modulating plug;

an actuator for effecting axial linear movement of the modulating plug within the diffuser;

a modulating stem, the modulating stem being disposed between and attached to the proximal end of the modulating plug and the actuator; and means for attaching the diffuser body to the steam inlet aperture of the liquid chamber;

wherein the axial linear position of the diffuser body is presented at an angle relative to the axial linear liquid flow path of the liquid chamber and the angle ranges between 90° and 50°.

2. The angled diffuser of claim 1 further comprising:

an external plug seal that is disposed at the proximal end of the diffuser body; and a seal support plate for retaining the external plug seal in position within the diffuser body.

3. For use with a direct contact steam injection heater assembly that comprises a liquid chamber, the liquid chamber comprising a fluid inlet, a fluid and steam outlet, and a steam inlet aperture disposed therebetween, an angled diffuser comprising:

a diffuser body attached to the steam inlet aperture of the liquid chamber, the diffuser body comprising a proximal end and a distal end, the diffuser body further comprising an axial linear position;

a plurality of diffusion holes defined within the distal end of the diffuser body;

a modulating plug that is movable within the diffuser body, the modulating plug comprising a proximal end and a distal end;

a sealing ring disposed at the distal end of the modulating plug;

an actuator for effecting axial linear movement of the modulating plug within the diffuser; and a modulating stem, the modulating stem being disposed between and attached to the proximal end of the modulating plug and the actuator;

wherein the liquid chamber defines an axial linear liquid flow path through the liquid chamber; and wherein the axial linear position of the diffuser is presented at an angle relative to the axial linear liquid flow path of the liquid chamber.

4. The angled diffuser of claim 3 further comprising:

an external plug seal that is disposed at the proximal end of the diffuser body; and a seal support plate for retaining the external plug seal in position within the diffuser body.

5. The angled diffuser of claim 4 wherein the angle that the axial linear position of the diffuser body presents to the axial linear liquid flow path of the liquid chamber ranges between 90° and 50°.

6. A direct contact steam injection heater assembly comprising:

a liquid chamber, the liquid chamber comprising a fluid inlet, a fluid and steam outlet, and a steam inlet aperture disposed therebetween;

an angled diffuser, the angled diffuser comprising a diffuser body attached to the steam inlet aperture of the liquid chamber, the diffuser body comprising a proximal end and a distal end, the diffuser body further comprising an axial linear position;

a plurality of diffusion holes defined within the distal end of the diffuser body;

a modulating plug that is movable within the diffuser body, the modulating plug comprising a proximal end and a distal end;

a sealing ring disposed at the distal end of the modulating plug;

an actuator for effecting axial linear movement of the modulating plug within the diffuser; and a modulating stem, the modulating stem being disposed between and attached to the proximal end of the modulating plug and the actuator;

wherein the liquid chamber defines an axial linear liquid flow path through the liquid chamber; and wherein the axial linear position of the diffuser is presented at an angle relative to the axial linear liquid flow path of the liquid chamber.

7. The injection heater assembly of claim 6 further comprising:

an external plug seal that is disposed at the proximal end of the diffuser body; and a seal support plate for retaining the external plug seal in position within the diffuser body.

8. The injection heater assembly of claim 7 wherein the angle that the axial linear position of the diffuser body presents to the axial linear liquid flow path of the liquid chamber ranges between 90° and 50°.

* * * * *